US008012225B2

(12) United States Patent
Pineschi

(10) Patent No.: US 8,012,225 B2
(45) Date of Patent: Sep. 6, 2011

(54) FILTER SUPPORT FOR A VACUUM CLEANER

(75) Inventor: Massimiliano Pineschi, Villanova (IT)

(73) Assignee: Aertecnica S.p.A. (IT)

( * ) Notice: Subject to any disclaimer, the term of this patent is extended or adjusted under 35 U.S.C. 154(b) by 696 days.

(21) Appl. No.: 12/066,592

(22) PCT Filed: Sep. 11, 2006

(86) PCT No.: PCT/EP2006/066242

§ 371 (c)(1),
(2), (4) Date: Jun. 5, 2008

(87) PCT Pub. No.: WO2007/031497

PCT Pub. Date: Mar. 22, 2007

(65) Prior Publication Data

US 2009/0113662 A1 May 7, 2009

(30) Foreign Application Priority Data

Sep. 12, 2005 (IT) ..... BO2005A0553

(51) Int. Cl.
*B01D 46/00* (2006.01)

(52) U.S. Cl. ..... 55/298; 55/300; 55/304; 15/352

(58) Field of Classification Search ..... 55/298, 55/300, 301, 304, 305, 404, 405; 15/352, 15/353, 5, 141.1, 347, 381, 382, 383, 386, 15/387; 95/282

See application file for complete search history.

(56) References Cited

U.S. PATENT DOCUMENTS

| | | | | |
|---|---|---|---|---|
| 2,684,125 | A * | 7/1954 | Brace | 55/305 |
| 3,731,465 | A * | 5/1973 | Ohira et al. | 55/299 |
| 3,759,014 | A * | 9/1973 | Van Dyken et al. | 95/76 |
| 4,099,940 | A * | 7/1978 | Mortensen et al. | 55/300 |
| 4,565,555 | A * | 1/1986 | Menasian | 55/288 |
| 4,704,144 | A * | 11/1987 | LeBlanc et al. | 55/300 |
| 5,090,083 | A * | 2/1992 | Wulff | 15/347 |
| 5,194,077 | A * | 3/1993 | Bargiel et al. | 55/300 |
| 5,233,005 | A * | 8/1993 | Kobayashi | 528/12 |
| 5,603,740 | A * | 2/1997 | Roy | 55/283 |
| 5,681,363 | A * | 10/1997 | Tucker et al. | 55/300 |
| 6,625,845 | B2 * | 9/2003 | Matsumoto et al. | 15/353 |
| 6,949,130 | B1 * | 9/2005 | Grey et al. | 55/305 |
| 7,736,406 | B2 * | 6/2010 | Kuroki et al. | 55/300 |
| 2006/0070358 | A1 * | 4/2006 | Oda et al. | 55/295 |

FOREIGN PATENT DOCUMENTS

| | | |
|---|---|---|
| DE | 894 306 | 10/1953 |
| DE | 1 056 339 | 4/1959 |
| GB | 634 995 | 3/1950 |
| WO | WO 01/32066 | 5/2001 |

OTHER PUBLICATIONS

International Search Report for PCT/EP2006/066242 mailed Dec. 12, 2006.

* cited by examiner

*Primary Examiner* — Duane Smith
*Assistant Examiner* — Thomas McKenzie
(74) *Attorney, Agent, or Firm* — Laubscher & Laubscher, P.C.

(57) ABSTRACT

A filter support for a vacuum cleaner is provided with a frame suitable for supporting a filter and with a shaking device for making the frame vibrate in use, which has an actuator provided with a fan that is rotated by an air flow that in use passes through the frame.

14 Claims, 5 Drawing Sheets

FILTER SUPPORT FOR A VACUUM CLEANER

CROSS-REFERENCE TO RELATED APPLICATIONS

This application is the U.S. national phase of International Application No. PCT/EP2006/066242, filed 11 Sep. 2006, which designated the U.S., and claims priority to Italian Patent Application No. BO2005A000553, filed 12 Sep. 2005, the entire contents of these applications are hereby incorporated by reference.

The present invention relates to a filter support for a vacuum cleaner.

The present invention is applied advantageously to a canister vacuum cleaner, to which the description that follows will refer explicitly without thereby losing general relevance.

A canister vacuum cleaner comprises a cylindrical container, which is provided with wheels and encloses a lower collecting chamber intended for collecting sucked material; the collecting chamber has a side opening, at which a flexible pipe is fixed that is used for the suction.

The cylindrical container further houses a motor-driven vacuum cleaner, which is arranged above the collecting chamber and communicates with the collecting chamber through a suction opening to generate a vacuum within the collecting chamber.

At the suction opening a filter is arranged, which prevents the sucked material in the collecting chamber from passing through the suction opening and then being returned into the environment by the vacuum cleaner. Normally, the filter is cup-shaped and is supported by a cradle, which is also cup-shaped and is mounted in a fixed position inside the cylindrical container at the suction opening. It has been noted that after a certain number of hours of operation the filter tends to get clogged, thus increasing the resistance to the passage of the air and decreasing suction power and so suction efficiency. In order to prevent or at least limit soiling of the filter, it has been proposed to use an electric actuator arranged inside the cradle that supports the filter to "shake" periodically the filter, making the cradle vibrate; the filter subjected to this "shaking" releases the material located on the filter, making the material drop back inside the collecting chamber.

Typically, the electric actuator is mechanically connected to the cradle that supports the filter, rotates an eccentric mass and is driven for short periods at preset time intervals.

Nevertheless, the use of an electric actuator arranged inside the cradle that supports the filter is expensive (also because of the additional electric cables), requires electronic control to drive the electric actuator for short periods at preset time intervals, and poses operating problems in the case of wet or damp environments (typically when the vacuum cleaner is used to suck water or wet materials).

The object of the present invention is to obtain a filter support for a vacuum cleaner, which filter support is devoid of the drawbacks disclosed above and is easy and cheap to produce.

According to the present invention a filter support for a vacuum cleaner is realized according to what is established in the enclosed claims.

The present invention will now be disclosed with reference to the enclosed drawings, which show an exemplifying and non-limitative embodiment thereof, in which.

Figure 1:
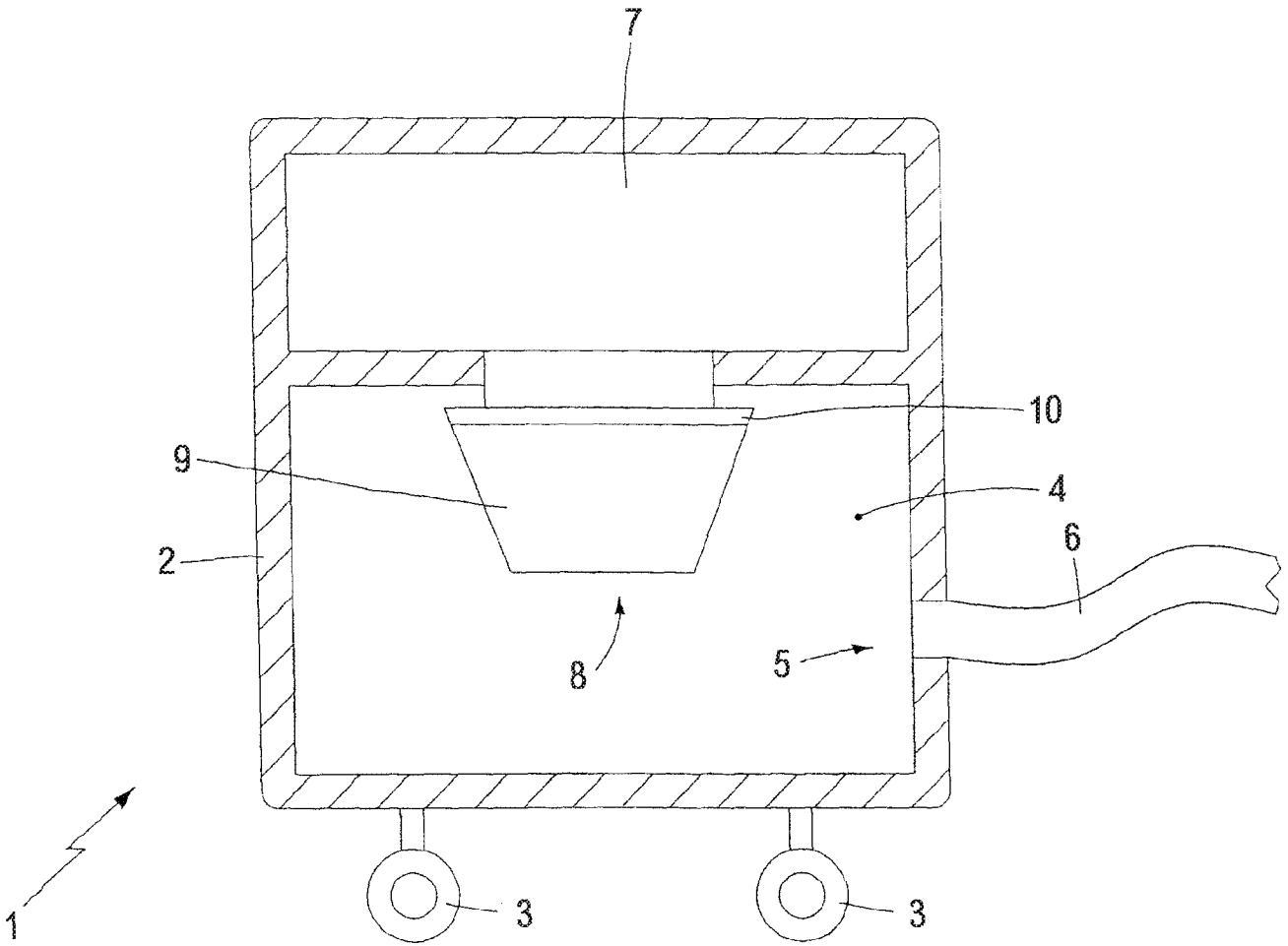
FIG. 1 is a schematic view of a canister vacuum cleaner provided with a filter support realized according to the present invention.
Figure 2:
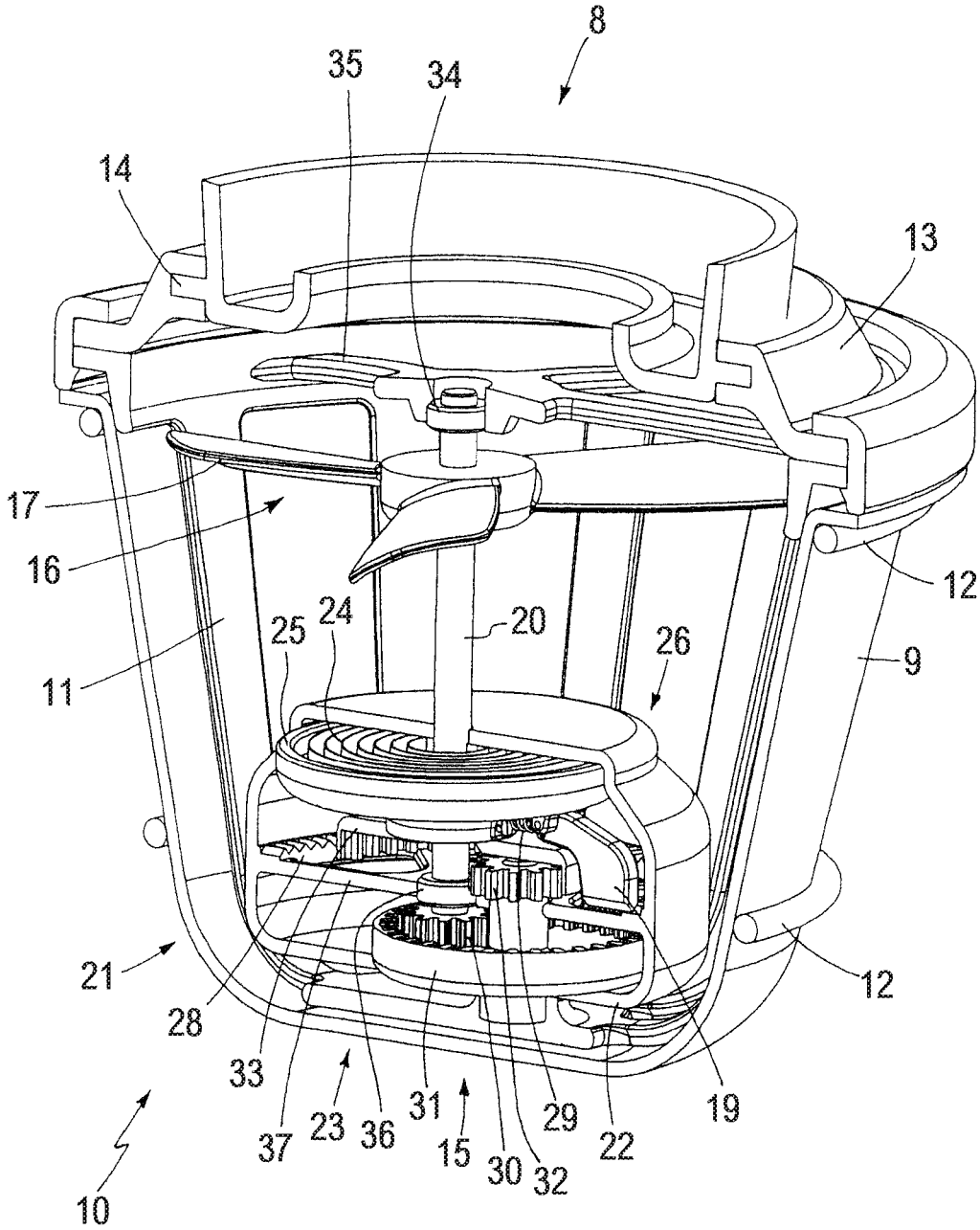
FIG. 2 is a perspective view, that is partially sectioned and with some details removed for clarity, of the filter support in FIG. 1.
Figure 3:
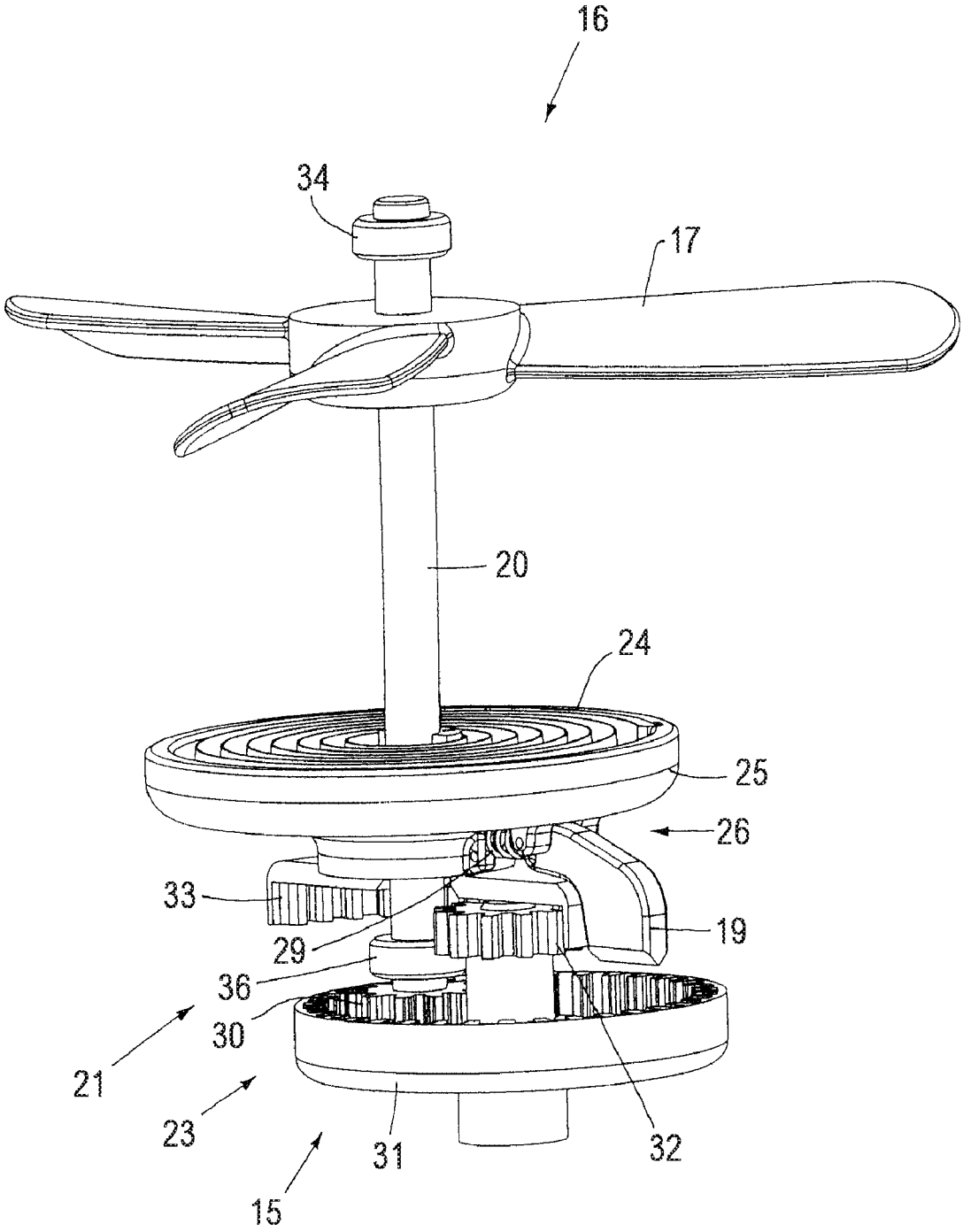
FIG. 3 is a perspective view of a detail of the filter support in FIG. 1.
Figure 4:
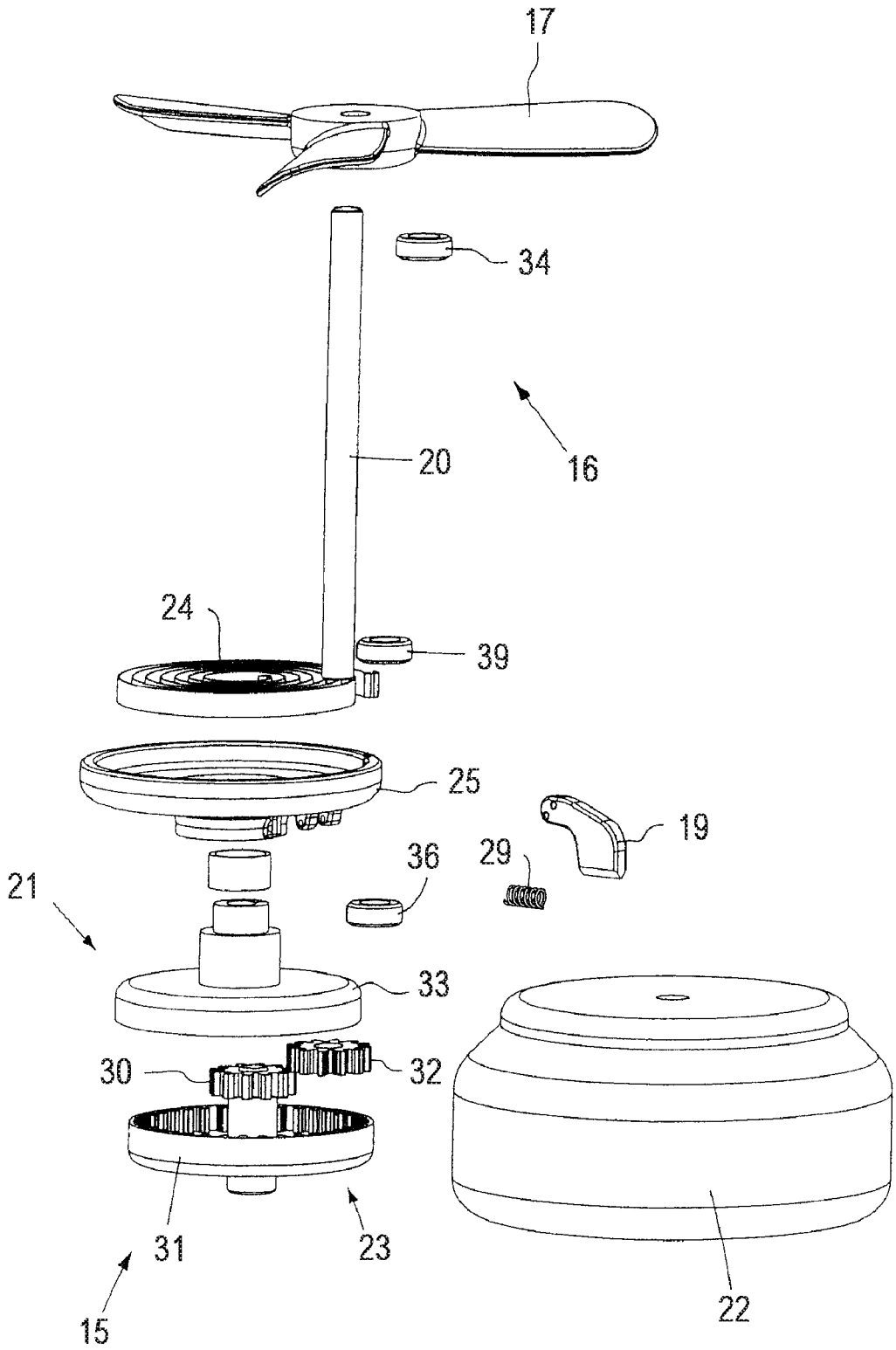
FIG. 4 is an exploded perspective view of the detail in FIG. 3.
Figure 5:
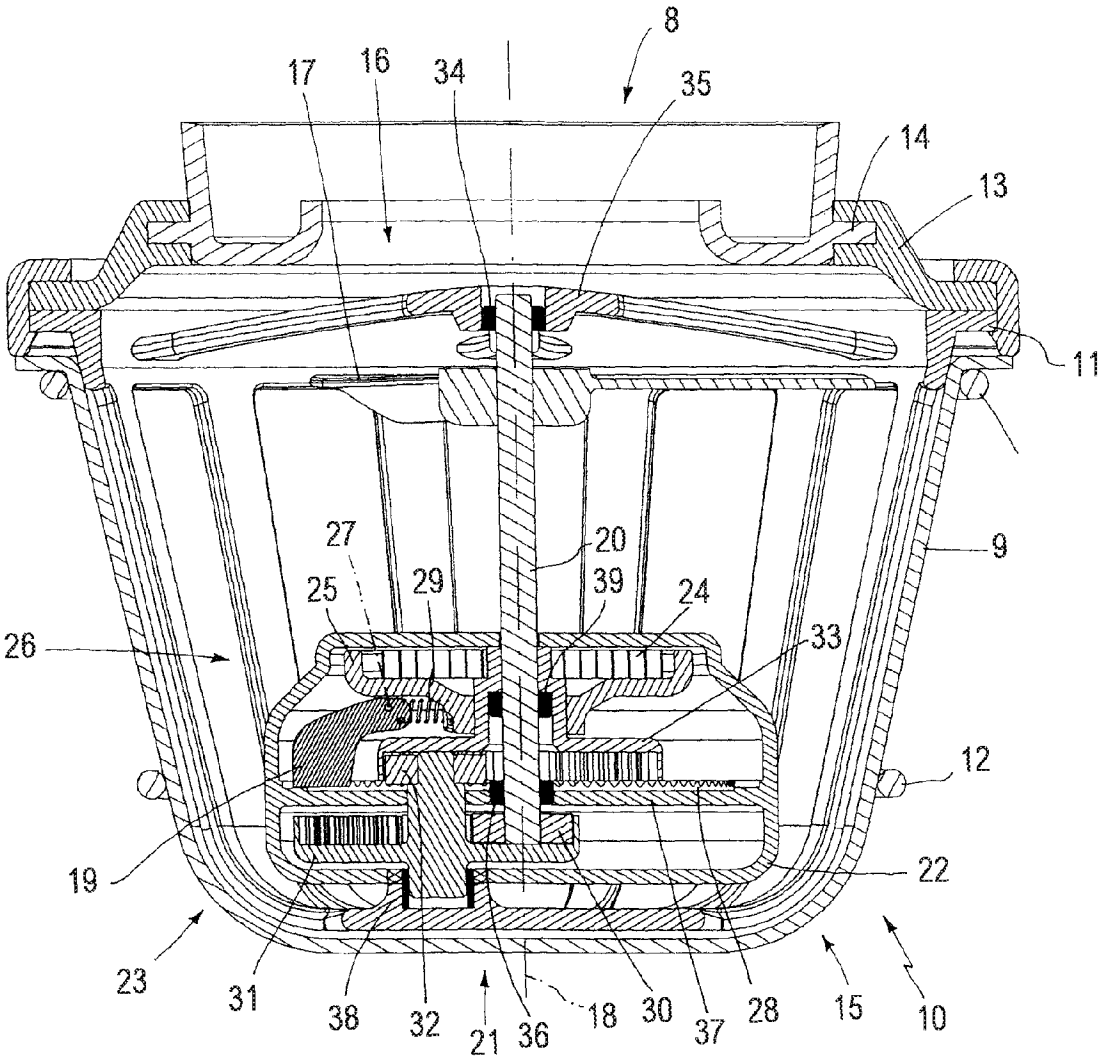
FIG. 5 is a section view of the filter support in FIG. 1.

In FIG. 1, with 1 there is indicated overall a canister vacuum cleaner, which comprises a cylindrical container 2 provided with wheels 3 that encloses a lower collecting chamber 4 provided for collecting the sucked material. The collecting chamber 4 has a side opening 5, at which a flexible pipe 6 is fixed that is used for suction.

The cylindrical container 2 further houses a motor-driven vacuum cleaner 7, which is arranged above the collecting chamber 4 and communicates with the collecting chamber 4 through a suction opening 8 to generate a vacuum inside the collecting chamber 4.

At the suction opening 8 there is arranged a filter 9, which prevents the sucked material located in the collecting chamber from passing through the suction opening 8 and then being returned into the environment by the vacuum cleaner 7. The filter 9 is cup-shaped and is supported by a filter support 10, which is also cup-shaped and is mounted on the cylindrical container 2 at the suction opening 8.

According to what is illustrated in FIGS. 2-5, the filter support 10 comprises a frame 11 consisting of a cup-shaped cradle, around which the filter 9 is fixed, which is kept in position by two elastic rings 12. The frame 11 is connected to the cylindrical container 2 at the suction opening 8 by means of a connecting ring 13, which is made of elastic material; in particular the connecting ring 13 is on one side connected mechanically to the frame 11 and on the other side is connected mechanically to a flange 14 obtained inside the cylindrical container 2. The presence of the elastic connecting ring 13 enables the frame 11 to vibrate freely with respect to the container 2.

Further, the filter support 10 comprises a shaking device 15, which is arranged inside the frame 11 and is suitable for making the frame 11 vibrate. The shaking device 15 comprises a pneumatic actuator 16 provided with a fan 17, which is rotated around a central axis 18 thereof by an air flow that passes through the frame 11 and moves from the collecting chamber 4 to the motor-driven vacuum cleaner 7. The shaking device 15 further comprises an eccentric mass 19, which is rotated around the axis 18 by rotation of the fan 17 and receives motion from a shaft 20 of the fan 17 through a mechanical transmission 21 housed inside a container 22 arranged in a fixed position inside the frame 11. The object of the container 22 is to protect the mechanical transmission 21 from dirt.

The mechanical transmission 21 comprises a set 23 of gears that reduces the motion of the shaft 20 of the fan 17 (i.e. reduces rotation speed) and loads a first spring 24 that rotates the eccentric mass 19, said first spring 24 being a coil-shaped balance-like spring. In particular, the balance-like spring 24 is arranged inside a cup body 25, which is rotatably mounted to rotate around the central axis 18, which supports the eccentric mass 19 and is fixed to an external end of the balance-like spring 24; an internal end of the balance-like spring 24, opposite the external end, is fixed to an outlet of the set 23 of gears and then receives the motion from the shaft 20 of the fan 17 through the set 23 of gears.

Preferably, there is provided a retaining mechanism 26 that keeps the eccentric mass 19 stationary with a force of set intensity. In particular, the eccentric mass 19 is hinged on the cup body 25 to rotate around a horizontal rotation axis 27 (illustrated in FIG. 5) to move between an engagement position, in which the eccentric mass 19 is in contact with a toothed circular crown 28, and a disengagement position, in which the eccentric mass 19 is not in contact with the toothed circular crown 28. A second spring 29 connected between the eccentric mass 19 and the cup body 25 pushes the eccentric mass 19 against the circular crown 28 with a set force.

In use, when the vacuum cleaner 1 is switched off the spring 24 is released completely and the fan 17 is stationary; in this situation, the spring 29 pushes the eccentric mass 19 downwards against the toothed circular crown 28. When the vacuum cleaner 1 is switched on, the air flow that moves from the containing chamber 2 to the vacuum cleaner 7 and through the filter support 10 rotates the fan 17 that starts to load the balance-like spring 24; consequently, the balance-like spring 24 starts to apply torque to the eccentric mass 19. Nevertheless, at the start the torque applied to the eccentric mass 19 by the balance-like spring 24 is not sufficient to overcome the force of the spring 29 and so the eccentric mass 19 remains stationary in contact with the toothed circular crown 28. At a certain point, the balance like spring 24 is loaded in such a way as to exert on the eccentric mass 19 sufficient torque to overcome the force of the spring 29; at this point the eccentric mass 19 detaches from the circular crown 28 and starts to rotate. Through the effect of the centrifugal force generated by the rotation on the eccentric mass 19, the eccentric mass 19 rotating around the horizontal rotation axis 27 moves upwards slightly, no longer touching the circular crown 28 until the eccentric mass 19 stops rotating around the axis 18 following the unloading of the balance-like spring 24. In other words, the centrifugal force that is generated on the eccentric mass 19 when the eccentric mass 19 rotates around the central axis 18 moves away the eccentric mass 19 from the toothed circular crown 28.

From what has been disclosed above, it is clear that in use the eccentric mass 19 rotates around the axis 18 at high speed for short periods of activity interrupted by longer rest periods, during which the eccentric mass 19 is stationary. In other words, the energy generated by the rotation of the fan 17 is accumulated by the balance-like spring 24 and is released during short periods of activity interrupted by longer rest periods, during which the eccentric mass 19 is stationary. This operating mode is particularly advantageous, inasmuch as it enables effective cleaning of the filter 9 to be obtained, reducing to the indispensable minimum the absorption of energy and the mechanical stress.

The set 23 of gears comprises a first toothed wheel 30 keyed on the shaft 20 of the fan 17 and which engages with a second toothed wheel 31 that is integral with a third toothed wheel 32 that in turn engages with a fourth toothed wheel 33 connected to the balance-like spring 24. The first toothed wheel 30 has a series of teeth on the external periphery thereof, and the second toothed wheel 31 is cup-shaped, has a series of teeth on the internal periphery thereof and houses therein the first toothed wheel 30. The third toothed wheel 32 has a series of teeth on the external periphery thereof, and the fourth toothed wheel 33 is cup-shaped, has a series of teeth on the internal periphery thereof and houses therein the third toothed wheel 32.

The shaft 20 of the fan 17 is guided by an upper bearing 34 mounted on a spider 35 that is integral with the frame 11 and is guided by a lower bearing 36, which is mounted on an internal plate 37 of the container 22. The first toothed wheel 30 is keyed onto, and then supported by, the shaft 20 of the fan 17. The second toothed wheel 31 is mounted on a first bearing 38 fixed to the frame 11 at the fixing zone between the frame 11 and the container 22; the third toothed wheel 32 is integral with the second toothed wheel 31 and is therefore supported by the second toothed wheel 31. The fourth toothed wheel 33 is supported by the shaft 20 through interposition of a second bearing 39. And lastly, the cup body 25 is supported by the external end of the balance-like spring 24 which, in turn, is supported by the fourth toothed wheel 33 to which it is connected at the internal end thereof.

According to a different embodiment that is not illustrated, the eccentric mass 19 is connected directly to the shaft 20 of the fan 17 to be rotated directly by the fan 17: in other words, the mechanical transmission 21 is not present. This embodiment is constructionally simpler, but on the other hand provides more modest performance and does not enable shaking to be made periodical.

The filter support 10 disclosed above has numerous advantages, as it is simple and cheap to actuate, not requiring the use of an electric actuator and of the corresponding electronic control. Further, this filter support 10 can operate without any problem in the presence of humidity or water. Lastly, this filter support 10 is simple to integrate and mount in any type of commercially available canister vacuum cleaner, inasmuch as it does not require any type of connection except for normal mechanical fixing.

Obviously, in the light of the numerous advantages, the filter support 10 disclosed above can be used advantageously in any type of vacuum cleaner in which it is necessary to clean the filter periodically.

The invention claimed is:

1. A filter support for a vacuum cleaner comprising a frame suitable for supporting a filter and a shaking device for making the frame vibrate in use, said shaking device comprising an actuator driven by an air flow that in use passes through the frame, said actuator comprising a fan which is rotated around a central axis thereof by an air flow that in use passes through the frame, said shaking device comprising an eccentric mass which is rotated around said central axis by rotation of said fan, said shaking device comprising a first spring that is loaded by the rotation of a shaft of said fan, said eccentric mass being mechanically connected with said first spring to be rotated by said first spring, said first spring being a balance-like spring and comprising an internal end connected with said shaft and an external end connected to said eccentric mass, wherein said first spring is arranged inside a cup-shaped body, said cup-shaped body being mounted rotatably to rotate around said central axis supporting said eccentric mass and being fixed to the external end of said first spring.

2. The filter support according to claim 1, wherein the energy generated by the actuator is accumulated by said first spring and is released during short periods of activity interrupted by rest periods.

3. The filter support according to claim 1, wherein said eccentric mass is connected directly to a shaft of said fan.

4. The filter support according to claim 1, wherein the shaking device comprises a retaining mechanism, which keeps the eccentric mass stationary with a force of set intensity.

5. The filter support according to claim 4, wherein the eccentric mass is hinged to move between an engagement position, wherein the eccentric mass is in contact with a circular crown, and a disengagement position, wherein the eccentric mass is not in contact with said circular crown, said shaking device comprising a second spring that pushes the eccentric mass against said circular crown with a set force.

6. The filter support according to claim 5, wherein said circular crown is toothed and has a plurality of radial teeth.

7. The filter support according to claim 5, wherein a centrifugal force that is generated on the eccentric mass when the eccentric mass rotates around said central axis moves the eccentric mass away from said circular crown.

8. The filter support according to claim 1, wherein said first spring is connected to said shaft of the fan through a set of gears.

9. The filter support according to claim 8, wherein said set of gears comprises a first toothed wheel keyed onto the shaft of the fan and which engages with a second toothed wheel that is integral with a third toothed wheel that in turn engages with a fourth toothed wheel connected to the first spring.

10. The filter support according to claim 9, wherein the first toothed wheel has a series of teeth on the external periphery thereof and the second toothed wheel is cup-shaped, has a series of teeth on the internal periphery thereof and houses therein the first toothed wheel; the third toothed wheel has a series of teeth on the external periphery thereof, and the fourth toothed wheel is cup-shaped, has a series of teeth on the internal periphery thereof and houses therein the third toothed wheel.

11. The filter support according to claim 10, wherein the first toothed wheel is keyed on the shaft of the fan, the second toothed wheel is mounted on a first bearing fixed to the frame, the third toothed wheel is integral with the second toothed wheel, and the fourth toothed wheel is supported by said shaft through interposition of a second bearing.

12. The filter support according to claim 8, wherein the set of gears, the first spring and the eccentric mass are arranged inside a container arranged in a fixed position inside the frame.

13. The filter support according claim 1, wherein said frame consists of a cup-shaped cradle, inside which the shaking device is arranged.

14. The filter support according to claim 1, further comprising a connecting ring, which is made of an elastic material and on one side is connected mechanically to the frame and on another side is suitable for being connected mechanically to the vacuum cleaner.

* * * * *